US008789726B2

(12) United States Patent
Segers

(10) Patent No.: US 8,789,726 B2
(45) Date of Patent: Jul. 29, 2014

(54) TAPPING DEVICE, CONNECTING DEVICE FOR A BEVERAGE CONTAINER AND COOLING DEVICE FOR SUCH A CONNECTING DEVICE

(75) Inventor: Roelof Anton Segers, Bussum (NL)

(73) Assignee: Heineken Supply Chain B.V., Amsterdam (NL)

( * ) Notice: Subject to any disclaimer, the term of this patent is extended or adjusted under 35 U.S.C. 154(b) by 450 days.

(21) Appl. No.: 12/602,361

(22) PCT Filed: Jun. 2, 2008

(86) PCT No.: PCT/NL2008/050337

§ 371 (c)(1),
(2), (4) Date: Mar. 16, 2010

(87) PCT Pub. No.: WO2008/147200

PCT Pub. Date: Dec. 4, 2008

(65) Prior Publication Data

US 2010/0176156 A1 Jul. 15, 2010

(30) Foreign Application Priority Data

May 31, 2007 (NL) ..... 1033916

(51) Int. Cl.
*B67D 7/80* (2010.01)
*B67D 1/08* (2006.01)

(52) U.S. Cl.
CPC ..... *B67D 1/0857* (2013.01); *B67D 1/0867* (2013.01); *B67D 1/0837* (2013.01)
USPC ..... 222/146.6; 222/400.7

(58) Field of Classification Search
CPC .. B67D 1/0829; B67D 1/0857; B67D 1/0867; B67D 1/0868; B67D 1/0831; B67D 1/0834; B67D 1/0837
USPC ..... 222/146.6, 399, 146.1, 400.7, 148; 62/390–396
See application file for complete search history.

(56) References Cited

U.S. PATENT DOCUMENTS

| | | | | | |
|---|---|---|---|---|---|
| 2,048,665 | A | * | 7/1936 | Dolan et al. | 62/298 |
| 2,199,503 | A | * | 5/1940 | Martin | 62/393 |
| 2,257,070 | A | | 9/1941 | Perlick | |
| 2,618,938 | A | * | 11/1952 | Booth et al. | 62/64 |
| 2,646,667 | A | * | 7/1953 | Kromer | 62/99 |
| 2,771,752 | A | | 11/1956 | Tennant | |
| 3,865,276 | A | * | 2/1975 | Thompson | 222/146.6 |
| 4,094,445 | A | * | 6/1978 | Bevan | 222/1 |
| 4,305,527 | A | * | 12/1981 | McMillin et al. | 222/1 |

(Continued)

FOREIGN PATENT DOCUMENTS

| | | | | | |
|---|---|---|---|---|---|
| DE | 255838 | C | | 1/1911 | |
| EP | 1650157 | | * | 4/2006 | 222/146.6 |
| GB | 396637 | A | | 8/1933 | |
| JP | 11-189299 | | * | 7/1999 | 222/146.6 |

*Primary Examiner* — Lien Ngo
(74) *Attorney, Agent, or Firm* — Pearne & Gordon LLP

(57) ABSTRACT

A tapping device, comprising a container with at least one beverage valve and a connecting device for connection to and operation of the beverage valve, wherein cooling means are provided for cooling the connecting device, wherein for instance the container is filled with fermented beverage, in particular beer, and/or the connecting device is at least partly included in a cooled space. A cooling line or cooling jacket is optionally provided around said connecting device.

21 Claims, 7 Drawing Sheets

(56) References Cited

U.S. PATENT DOCUMENTS

| | | | | | |
|---|---|---|---|---|---|
| 4,676,400 | A * | 6/1987 | Lamont et al. | 222/1 |
| 5,090,440 | A * | 2/1992 | Ladouceur et al. | 137/209 |
| 5,535,923 | A * | 7/1996 | Fujioka | 222/148 |
| 5,564,602 | A * | 10/1996 | Cleland et al. | 222/146.6 |
| 5,988,859 | A * | 11/1999 | Kirk | 700/232 |
| 6,598,417 | B1 * | 7/2003 | Wilkes | 62/390 |
| 6,871,579 | B2 * | 3/2005 | Belkin et al. | 99/276 |
| 7,516,623 | B2 * | 4/2009 | Hall, Sr. | 62/297 |
| 8,365,547 | B2 * | 2/2013 | Bravo et al. | 62/264 |
| 2009/0230150 | A1 * | 9/2009 | Dietschi et al. | 222/146.6 |

* cited by examiner

TAPPING DEVICE, CONNECTING DEVICE FOR A BEVERAGE CONTAINER AND COOLING DEVICE FOR SUCH A CONNECTING DEVICE

The invention relates to a tapping device. In particular, the invention relates to a tapping device for tapping beverage, such as beer, from a container, such as a keg or tank.

Beverage, such as beer, can be stored in containers such as a keg or tank and be dispensed therefrom by a tapping device. To that end, such a tapping device comprises a line assembly with at least one draw-off tap and means for pressurizing the beverage. A connecting device is provided for connecting a beverage dispensing line of the line assembly to a container, so that beverage can be dispensed from the container, via the connecting device and the beverage dispensing line, to the draw-off tap. Such a tapping device should be regularly cleaned, wherein the connecting device is uncoupled from the container and is rinsed through with a cleaning liquid and then with clean water. After that, the connecting device can be recoupled to a container.

The connecting device is in particular sensitive to contamination, especially microbiological contamination.

An object of the invention is to provide, inter alia, an alternative tapping device.

A further object of the invention is to provide a tapping device that is microbiologically advantageous.

In a first aspect, a tapping device is characterized by a container with at least one beverage valve and a connecting device for connection to and operation of the beverage valve, wherein cooling means are provided for cooling the connecting device.

The cooling means allow for a favourable microbiological climate to be maintained in and around the connecting device.

In a second aspect, a tapping device is characterized by a remotely controllable regulating unit with which the beverage valve can be opened and a communication can be effected between an inner space of the container and a beverage dispensing line or communication can be effected between a rinsing line and the beverage dispensing line, with the beverage valve closed.

Use of a remotely controllable regulating unit offers the advantage that, if required, cleaning of the connecting device can simply be remotely deployed and regulated, from, for instance, behind a bar. Here, the cooling means ensures that the connecting device needs not be uncoupled from the container at each cleaning operation.

The invention further relates to a connecting device for a beverage container.

In a first aspect, a connecting device is characterized by a regulating mechanism for opening a beverage valve, wherein a first connection is provided for coupling to a beverage container and a second connection for connection to a beverage dispensing line, wherein cooling means are provided for cooling the connecting device, at least between the first and the second connection.

The cooling means offer the possibility of regulating the microbiological climate in and adjacent the beverage valve.

More particularly, harmful bacterial growth can be inhibited or even be largely or completely prevented during a longer period of time.

A tapping device according to the disclosure can be less sensitive to contamination than known tapping devices, so that shelf life and quality of beverage to be dispensed therewith is maintained better or is improved.

The invention further relates to a cooling device for a connecting device for a beverage container.

The invention will be further elucidated on the basis of the drawing. In the drawing:

FIGS. 1A-C show a connecting device in cross-sectioned side view, in tapping position and rinsing position, respectively;

Figure 3:
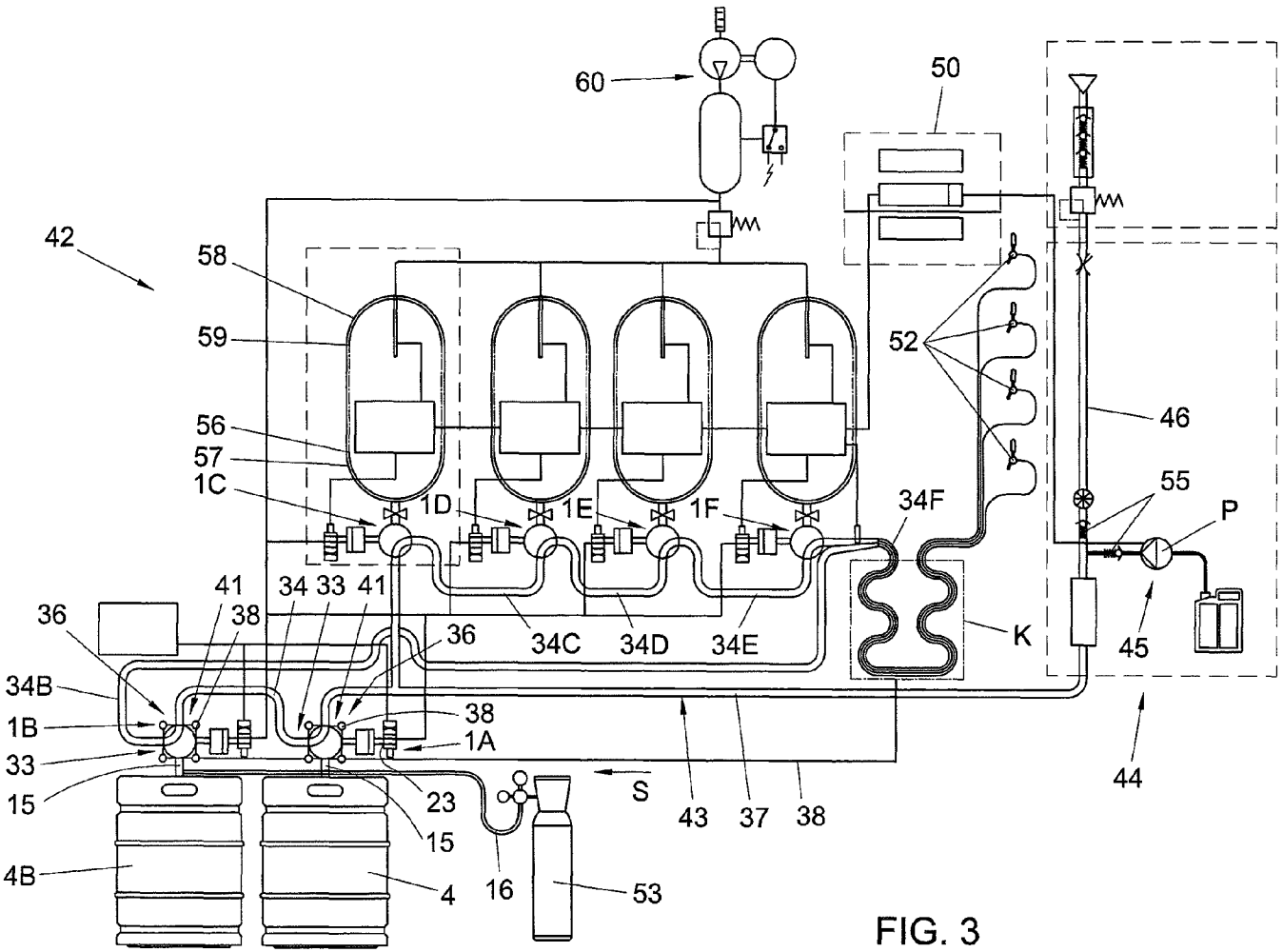

FIG. 3 schematically shows a tapping device; and

Figure 4A:
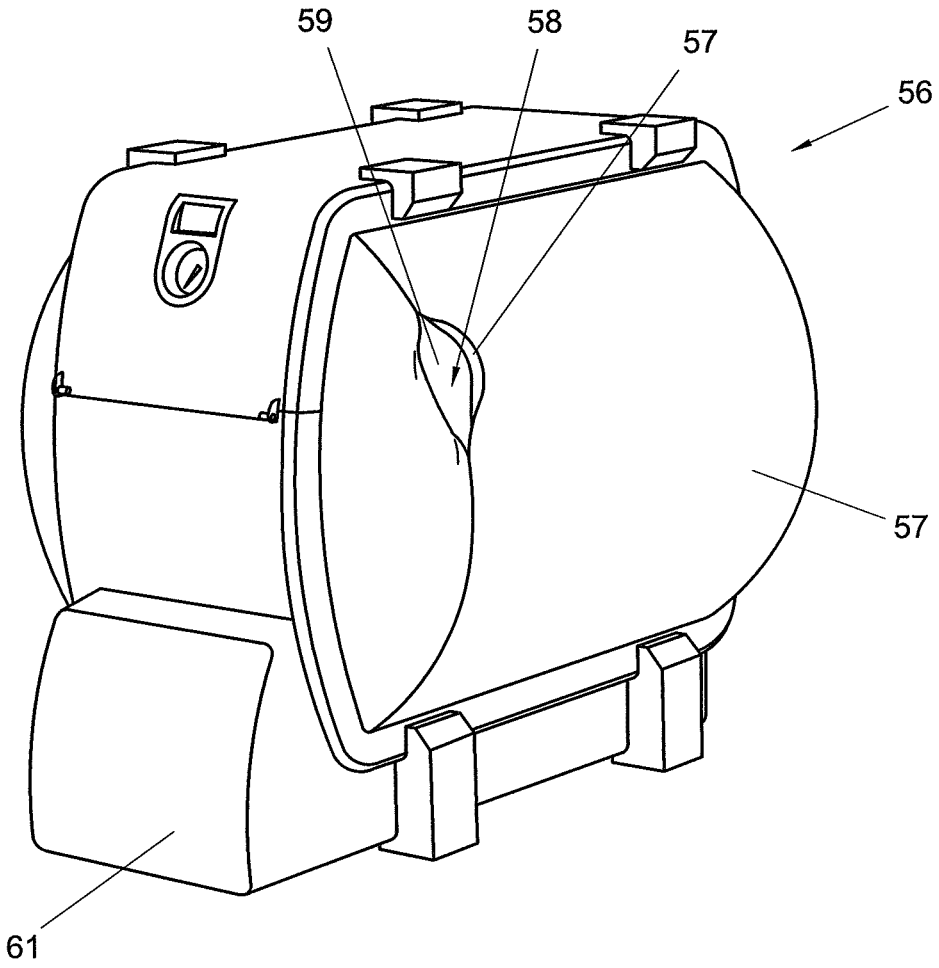

FIGS. 4A and B show an alternative embodiment of a container with cooled connecting device partly cutaway.

In this description, identical or corresponding parts have identical or corresponding reference numerals. The embodiments shown are shown merely by way of illustration and should not be construed to be limitative in any manner. Combinations of parts of the embodiments shown and other embodiments are possible within the invention. In this description, embodiments of a tapping device, connecting device, cooling device and methods will be described within the framework of dispensing beer. Other, in particular carbonated and/or fermented beverages are suitable too.

Figure 1A:
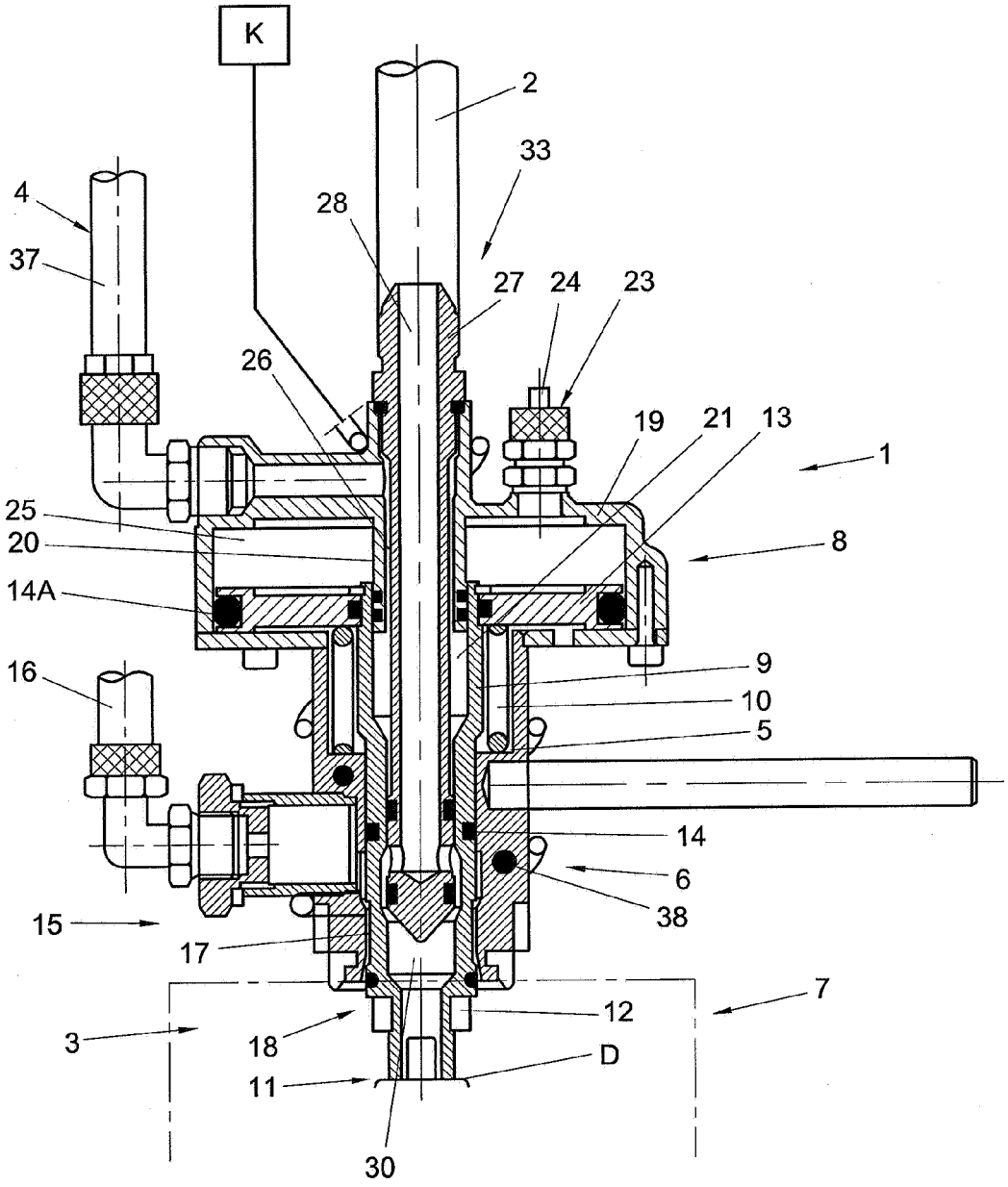
Figure 1B:
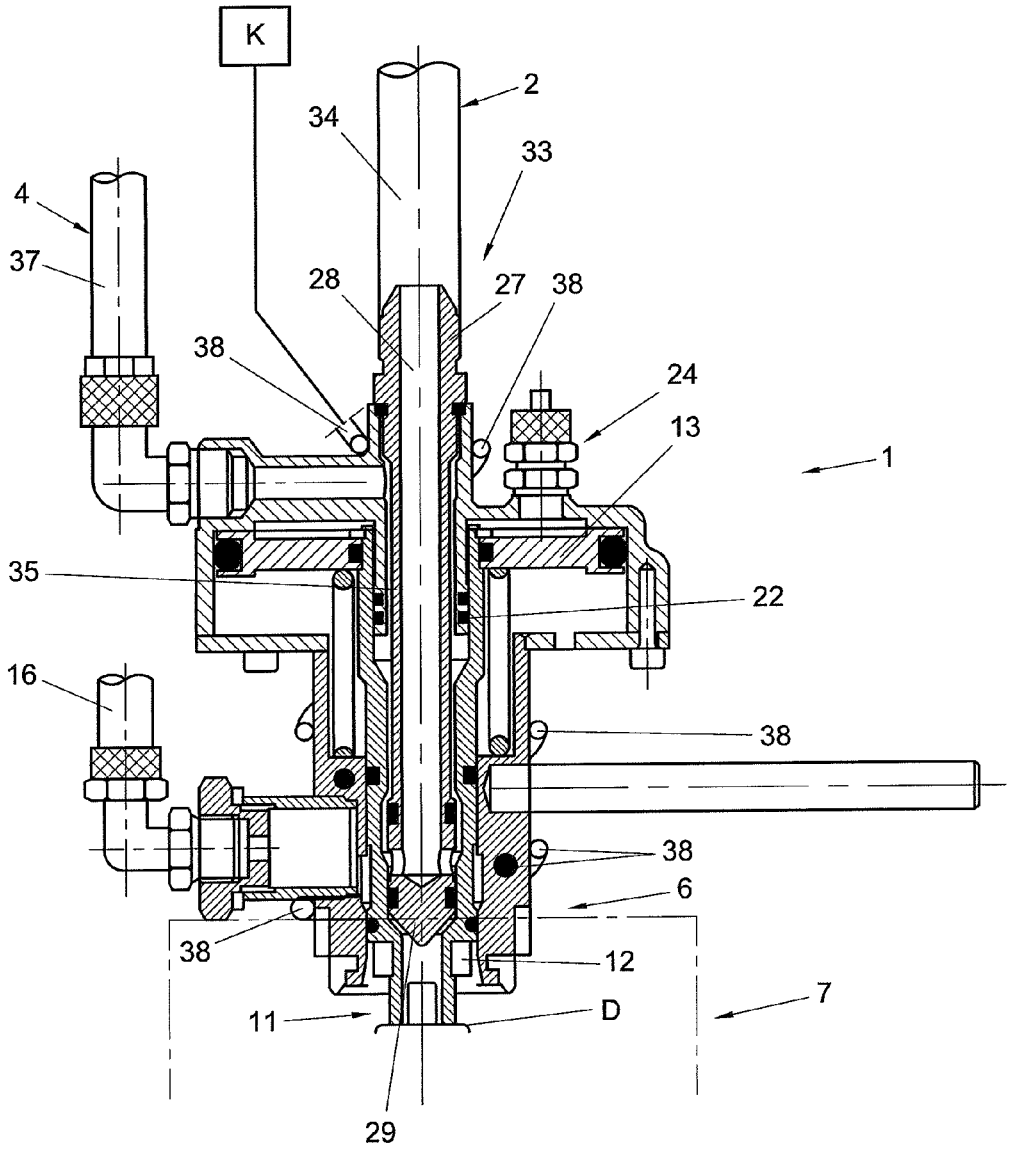
Figure 1C:
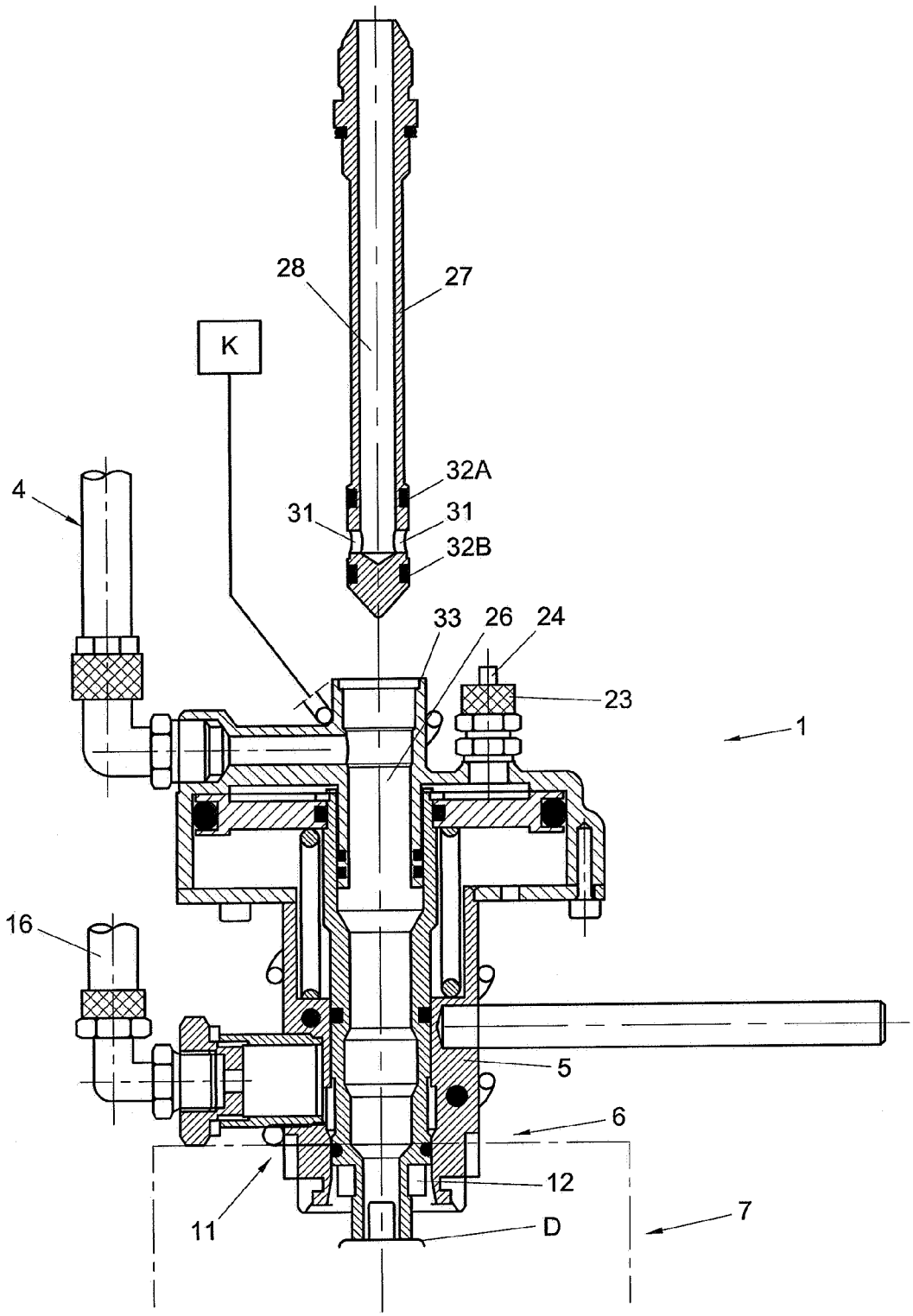

In FIGS. 1A-C, three positions are shown of a connecting device 1 for connecting a beverage dispensing line 2 to a container 3 and for connecting a rinsing line 4. The beverage dispensing line 2, container 3 and rinsing line 4 are represented here only in part and schematically, in interrupted lines. Connecting device 1, which is only an example of a connecting device 1, comprises a housing 5 with a first stub 6 with which it can be coupled to a keg 7, directly above a beverage valve D thereof. On a side of the housing 5 remote from the first stub 6, a widening 8 is provided. A piston rod 9 extends through a central bore 10 in the housing 5 and is provided, at a first end, adjacent the first stub 6 with a connecting nose 11 with a first gasket 12 for the purpose of sealing off around a beverage valve D, for separating a beverage stream and a gas stream. At a second end, the piston rod is connected to a piston 13 which is movable in the widening 8. Between the piston 13 and the gasket 12, a second gasket 14 is provided with abuts against the inside of the bore 10 and seals it off in a gastight manner. A fourth stub 15 links up with a slit-shaped space 17 between the bore 10 and the part of the piston rod below the second gasket 14. A gas supply line 16, for instance a CO2 line, is connectable to the fourth stub, for introducing gas via the fourth stub 15, the slit-shaped space 17 to the inner space of the keg 4, along a gas valve G. By moving the piston 13 downwards in the widening 8, in the direction of the keg 4, the connecting nose is pressed against the beverage valve D, thereby opening this and the gas valve G.

The widening 8 is closed at a top side by a closing part 19, which is provided with a bush 20 that fits within a widening 21 of the piston rod 9, wherein third gaskets 22 are provided between the widening 21 and the piston 13 and/or piston rod 9, so that a sliding sealing is obtained. In the closing part 19, a fifth stub 23 is provided to which a gas supply line 24 is connectable, for introducing into the space 25 above the piston 13 an operating pressure for operating the piston and hence opening the beverage valve and the gas valve.

Through the bush 20, the piston rod 9 and the closing part 19 extends a passage 26, which is straight here, and continues as far as into the connecting nose 11. During normal use, through the passage 26, a sealing rod 27 extends which rod is substantially hollow-cylindrical, with a central channel 28 and a closed first end 29 directed towards the connecting nose. The sealing rod 27 fits in the passage 26 with little clearance.

Adjacent the connecting nose 11, the passage 26 is provided with a widening 30. The sealing rod is provided adjacent the closed end 29 with inlet openings 31, placed, for instance, diametrically opposite each other. On both sides of the inlet openings 31, a gasket 32A, 32B is provided around the sealing rod. In the tapping position shown in FIG. 1A, the upper gasket 32A seals against the inside of the passage 26, while there is a space between the lower gasket 23B and the passage, so that beverage can flow from the container 4 via the inlet openings into the channel 28, in the direction of a second connecting stub 33 formed by the top end of the sealing rod 27. A beverage dispensing line 34 can link up with this second connecting stub 33. In the rinsing position in FIG. 1B, the lower second gasket 32B seals against the inside of the passage 26, below the widening 30. The purpose hereof will be explained further.

The sealing rod 27 seals at the upper side against the bush 20. Between the part of the passage 26 in the bush 20 and the sealing rod 26, a slit-shaped space 35 is provided. A third stub 36 links up with this space, to which stub a rinsing line 38 is connectable. In the rinsing position shown in FIG. 1B, rinsing liquid can be fed from the rinsing line 37 via the slit-shaped space 35 to the inlet openings 34, wherein the gasket 32B prevents liquid from flowing further in the direction of the keg 4. The liquid flows via the inlet openings 31 into the channel 28 and thence into the beverage dispensing line. If at least one draw-off tap that is connected to the beverage dispensing line is opened, the liquid can flow away through this draw-off tap, and the line circuit comprising this beverage dispensing device can be cleaned. Here, the piston 13 is pushed back upwards by the spring pressure of the beverage valve, so that no more gas can be pressed into the container, or can escape therefrom.

In FIG. 1C, it is indicated that the sealing rod 27 can simply be pulled from the passage 26.

As clearly appears from these Figures, rinsing liquid will not reach as far as the beverage valve, the lower part of the passage will always come and remain in contact with beverage. In order to protect at least this part from undesired bacterial growth, with this connecting device, a cooling line 38 is provided which extends around the connecting device and in particular around the part of the housing 5 extending around the lower part 39 of the passage 26, adjacent the connecting nose 11. During use, cooling medium is fed through the cooling line 38, in the exemplary embodiment shown cooled water. To that end, the cooling line 38 is connected to an in-line cooler K through which also the beverage dispensing line can be fed. The cooling line 38 and in particular the cooling medium has a temperature such that the respective lower part of the connecting device 1 is cooled to below 15° C., preferably to below 10° C. In the case of beer, it is advantageous when the temperature is maintained at approximately 6° C. As a result, the beverage in the connecting device is always brought to and maintained at a desired, low temperature, so that growth of bacteria is prevented or is at least delayed. In known tapping devices, usually the container, such as the keg 4, is cooled. By cooling the dispensing device and utilizing an in-line cooler for the beverage dispensing line, cooling of the container may, if required, be omitted, which, from a standpoint of energy and costs, is advantageous.

As a result of cooling, cleaning the installation is required less frequently, which is advantageous for management of the device. Furthermore, the risk of contamination of the beverage is considerably reduced. Further, it is energetically advantageous.

Figure 2A:
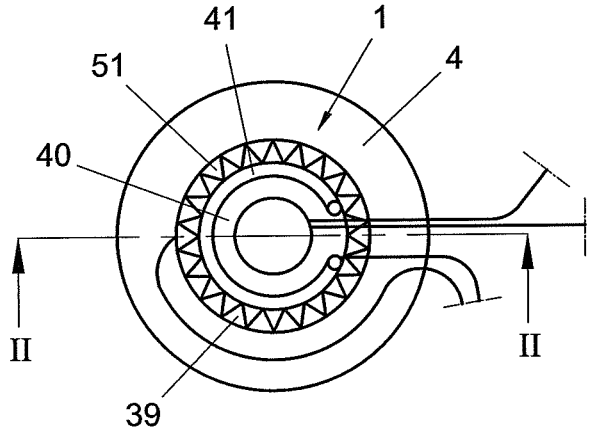
FIG. 2A shows, in top plan view, a container with connecting device, cross-sectioned along the line IIA-IIA in FIG. 2.
Figure 2:
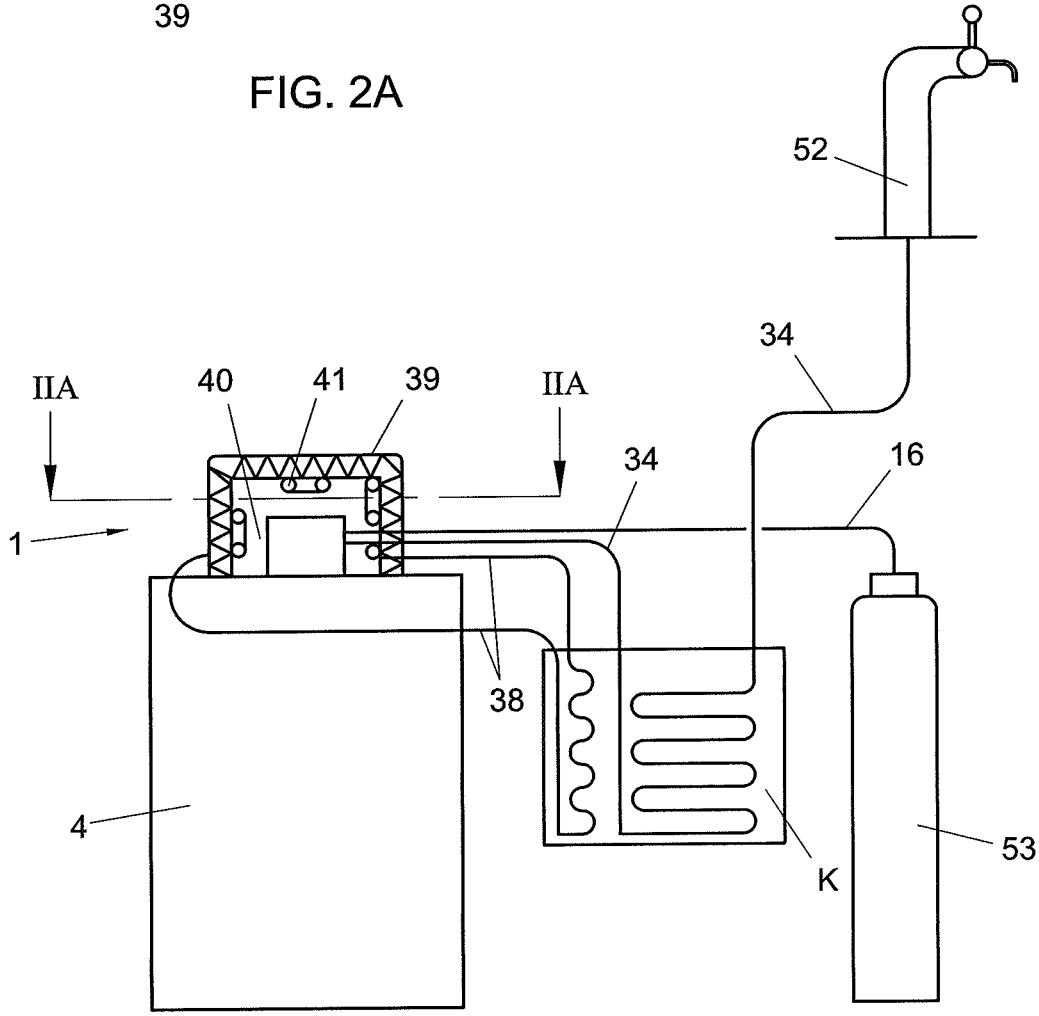
FIG. 2 shows a beverage dispensing device connected to a container, with cooling means over the connecting device, cross-sectioned along the line II-II in FIG. 2A.

In FIG. 2, an alternative embodiment of a tapping device with container 4 and connecting device 1 is shown. Here, the connecting device 1 is fastened on the container, in a customary manner, so that the beverage valve can be opened. The connecting device 1 may be according to FIG. 1, without or, optionally, with the cooling line 38. In this embodiment, over the connecting device, a cover 39 is provided which substantially covers the connecting device and encloses a space 40.

Cooling means 41 are provided for cooling the space 40, for instance by means of a cooling line 38 which extends therethrough and a good thermal insulation 51 of the cover 39. The cooling line 38 extends within the space 40 around the connecting device 1 and is led through an in-line cooler K or other cooling device, as is the tapping line 34 that leads to a draw-off tap 52. A gas line 16 leads to a gas bottle 53 or other source that ensures tapping pressure and/or operation of the connecting device 1. It is also possible that for instance electrically driven cooling means are provided, such as a Peltier cooling. Other applicable cooling means will be directly clear to the skilled person. By cooling the space 40 to below 15° C., more particularly below 10° C. and preferably below 6° C., in an earlier described manner, bacterial growth in a part of the connecting device directly above the beverage valve, where, during a normal cleaning cycle, cleaning liquid does not reach, is prevented or at least delayed, while additional cooling of the beverage is obtained during tapping. The cooling may take place independently of the keg.

Figure 4B:
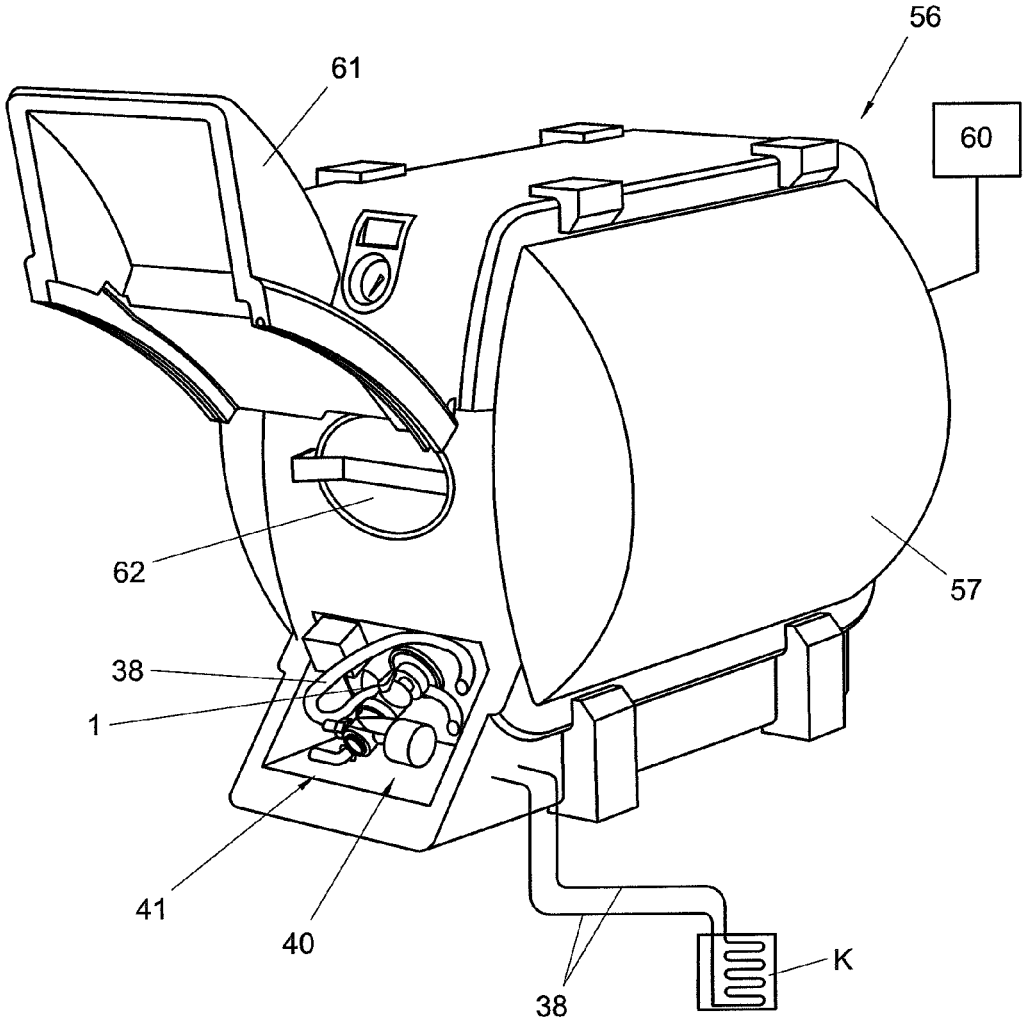

FIG. 3 schematically shows a tapping device 42, comprising a series of containers such as kegs 4, mutually connected by a line circuit 43. The circuit comprises a rinsing unit 44 for supply of rinsing water and dosing means 45 such as a dosing pump P for cleaning agent, connected to a water line 46 via non-return valves 55. A rinsing line 37 extends from the rinsing unit 44 to a first connecting device 1, for instance of the type described and shown in FIG. 1, and is connected to the third stub 36. A first beverage dispensing line 34 connected to the second stub 33 is connected to the third stub 36 of a second connecting device 1B on a second keg 4B, to which second connecting device 1B a second beverage dispensing line 34B is connected which is in communication with one or more taps 52. Via a branch 37A of the line 37, a series of tanks 56 is connected in the line circuit. These tanks 56 may be of a Bag In Container (BIC) type as known from cellar beer installations or as shown in, for instance, FIG. 4. These tanks 56, four of which are shown here, connected in series, each have a rigid outer container 57 and a flexible inner container 59 in which beverage to be disposed is or can be included. Pressure means such as a compressor 60 are provided for pressurizing the inner container 59.

Each of the tanks 56A-D is connected, via a connecting device 1C-1F to the line circuit. To that end, the branch 37A is connected to the connecting device 1C, which is connected, via an intermediate line 34C, to the connecting device 1D. Connecting device 1D is connected, via intermediate line 34D, to connecting device 1E, which is connected in turn, via an intermediate line 34E, to connecting device 1F, which is connected, via one or more tapping lines 34F, to the taps 52.

Each of the connecting devices 1C-1F can be switched, comparable to the connecting devices 1A and 1B, between a first position, in which the inner space of the inner container 59 is connected to the intermediate line 34C-E or tapping line 34F, connected thereto upstream, i.e. in the direction of the taps 52, and a second position in which, as shown in FIG. 3, the rinsing line 37 is connected to the intermediate lines 34C-E and the tapping line 34F or at least the rinsing line 37 is connected to a number of intermediate lines 34, located upstream of a holder 56 to be emptied through tapping.

Optionally, a third position can be provided, wherein neither a holder 56 nor a rinsing line or intermediate line is connected to a downstream intermediate line or tapping line.

It will be clear that in this manner, different connecting device 1 can be connected in series or parallel, in the same circuit, on kegs 4 or other containers 56 such as cellar beer tanks. For instance, per keg 4 or container 56, as shown in FIG. 2, a draw-off tap can be provided. To each connecting device 1A-B, an operating gas supply line 23 is connected to the fifth stub 24, and a gas supply line 16 to the fourth stub 15. With the holders 56, to that end, the compressor 60 is provided. The operating gas supply lines 23 are connected to a regulating unit 50, allowing remote control of the connecting devices 1

In order to tap from the kegs or other connected containers 4, the first connecting device 1A in the flow direction S is brought into the tapping position, so that the rinsing line is shut off. The further connecting devices 1B located downstream are brought into the rinsing position, so that beverage can be forced from the keg 4, foremost in flow direction, through introduction therein of gas via the fourth stub. The beverage flows via the first beverage dispensing line 34, the second connecting device 1B and the second beverage dispensing line 34B and, optionally, the in-line cooler, to the draw-off tap 52. When the first keg 4 is empty or otherwise dispensing of beverage therefrom is stopped, the first connecting device 1 is brought into the rinsing position, while the second connecting device is brought into the tapping position. Beverage in the first beverage dispensing line 34 can optionally be forced away by rinsing medium as far as into the second connecting device before this second connecting device 1B is brought into the tapping position. As a result, no beverage is lost. Thereupon, beverage is forced out of the second container 4B through introduction therein of gas via the respective fourth stub. During tapping of beverage and preferably also for as long as at least one of the connecting devices 1, 1B is in the tapping position, cooling medium is introduced, continuously or periodically, into the cooling lines 38 or with the cooling means 41 the spaces 40 are cooled, so that the connecting devices are kept cold. The supply of cooling medium can be controlled in the regulating unit 50, for instance on the basis of the temperature of the respective connecting devices 1, 1B. If this rises above a set maximum temperature, then, additional cooling medium will be fed through the cooling lines, until the temperature falls below a desired minimum temperature again. Also, at least when tapping is effected, cooling medium can be circulated through the connecting devices 1, in order to obtain additional cooling of the beverage. This happens in a tapping phase.

In a comparable manner, the holders 56 can be emptied, in particular sequentially, starting with the holder 56 foremost viewed in the inflow direction S.

When all kegs or containers have been emptied or the dispensing of beverage is stopped for other reasons, all connecting devices are brought into the rinsing position, at the start of the rinsing phase. Preferably with the aid of the regulating unit 50, the rinsing unit 44 introduces rinsing medium, such as water, into the rinsing line, whereby beverage in the lines is forced out of the draw-off tap or draw-off taps 52. This beverage can still be served because no mixing with rinsing agent will occur. With the dosing device 45, cleaning agent is supplied and for some time, for instance a predetermined time, the mixture of water and cleaning agent, such as rinsing liquid, is circulated through the circuit, thereby cleaning the lines. Then, the supply of cleaning agent is terminated and rinsing with clean water follows. In the rinsing phase for that matter, setting the lines "on water" can also suffice, this means that the line circuit is filled with water and is then closed, for instance until the start of a new tapping phase or until cleaning liquid is supplied. Then, once more, the connecting device 1, foremost viewed in the flow direction S, is brought into the tapping position and tapping can take place in the earlier described manner. As a result of the cooling, the connecting devices need not be taken apart and need to be cleaned further only rarely. Naturally, for that matter, also a different tapping order can be set and kegs 4 can be replaced between times.

It will be clear that the connecting device 1 forms or comprises a three-way valve, with which a selection can be made between connecting an inner space to a beverage dispensing line or a connecting a rinsing line to a beverage dispensing line. Also, a four-way or multi-way valve 1 can be utilized through which a holder 4, 56 can be filled as well as emptied. Optionally, the inner container 59 can be provided with a disposable valve or a squeeze seal.

FIGS. 4A and B show a tank or container 56 for use in a device according to the invention, which can be connected, through a connecting device 1, to the rinsing line 37 and/or a tapping line 34. The tank 56 is provided with a cooled or not cooled, preferably thermally insulated jacket 57 which defines an inner space 58. In this inner space, beverage can be stored, for instance in an inner container 59, such as a bag. Such a structure is generally known as Bag In Container (BIC) and is used in, for instance, cellar beer installations. With the aid of pressure means, such as a compressor 60, during use, the inner container 59 is pressurized and, with the respective connecting device 1 in the tapping position, beverage can be dispensed to one or more draw-off taps 52. In this embodiment, the connecting device 1 is included below a movable, preferably thermally insulated cover 61, which is shown in closed position in FIG. 4A and in open position in FIG. 4B. Once again, the cover 61 encloses a space 40 which, with the aid of a cooling line 38 or other cooling means as, for instance, discussed hereinabove, is preferably actively cooled to for instance below 15° C., preferably below 10° C. and more particularly to, for instance, 6° C. or less in order to optimize the beverage quality and preferably inhibit or even prevent bacterial growth. The inner container 59 can be exchanged through a hatch 62 placed below the cover 61 and can be filled by the connecting device.

The invention is not limited in any manner to the embodiments represented in the drawing and the description. Many variations thereon are possible within the framework of the invention as outlined by the claims.

For instance, a connecting device can be designed differently, for instance without the fourth stub if the container is pressed empty in another manner, for instance a bag-in-box container whose inner container is pressed empty by means of air pressure or mechanically. Also, keg coolers can be utilized and a line circuit can have a different lay-out, for instance without in-line cooler or with additional cooling means for cooling beverage further, for instance to almost, or below 0° C. Operating means for a connecting device can also be designed differently, for instance mechanically, hydraulically or electrically. These and many other variations, among which combinations of parts of the embodiments shown, are understood to have been represented in this description.

The invention claimed is:

1. A tapping device comprising a container, a connecting device, and a cooling line, the container having a beverage valve, the container having a beverage-holding portion for holding beverage in the container, the connecting device being connected to the container and being effective for operation of the beverage valve, the cooling line being effective for conveying a flow of a cooling medium, the cooling line not passing through the beverage-holding portion of the container, the cooling line (a) passing at least partly around or through the connecting device and sufficient to effectively cool at least a part of the connecting device or (b) passing through a space which is at least partly defined by a cover, the space containing at least a part of the connecting device, wherein the cooling line is effective to cool the space and thereby effectively cool at least the part of the connecting device.

2. A tapping device according to claim 1, wherein the container is filled with fermented beverage.

3. A tapping device according to claim 1, wherein the cooling line passes at least partly around or through the connecting device and is sufficient to effectively cool at least the part of the connecting device.

4. A tapping device according to claim 1, wherein the cooling line passes through the space and is effective to cool the space and thereby effectively cool at least the part of the connecting device in the space.

5. A tapping device according to claim 1, wherein the cooling line is effective for cooling the beverage valve, at least a part thereof facing outwards of the container.

6. A tapping device according to claim 1, wherein the connecting device has a remotely operable regulating unit with which the beverage valve can be opened and a communication can be effected between an inner space of the container and a beverage dispensing line or communication can be effected between a rinsing line and the beverage dispensing line, with the beverage valve closed.

7. A connecting device for a beverage container, comprising a regulating mechanism for opening a beverage valve, wherein a first connection is provided for coupling to a beverage container and a second connection is provided for connection to a beverage dispensing line, wherein a cooling line is provided for and is effective for cooling the connecting device, at least between the first and the second connections, wherein the cooling line is effective for conveying a flow of a cooling medium, the cooling line passing at least partly around and/or through the connecting device.

8. A connecting device according to claim 7, wherein a third connection is provided for connection of a rinsing line.

9. A connecting device according to claim 8, wherein the cooling line is effective for cooling the connecting device between the first, second and third connections.

10. A connecting device according to claim 7, wherein the cooling line is connectable to an in-line cooler of a tapping device.

11. A method for managing a beverage container, comprising the steps of:

(a) coupling a connecting device according to claim 7 to the beverage container;

(b) connecting a beverage dispensing line to the beverage container with the aid of the connecting device;

(c) opening a beverage valve of the container with the connecting device;

(d) cooling the connecting device at a temperature below 15° C. via a flow of the cooling medium through the cooling line; and (e) cooling the connecting device independently of the beverage container.

12. A method for managing a tapping device, the tapping device comprising a series of beverage containers and a line circuit connected thereto, wherein the line circuit has a flow direction, the method comprising the steps of:

(a) connecting a connecting device according to claim 7 to each beverage container, wherein:

in a tapping phase:

(b) at least one of the connecting devices is set such that beverage from the respective container can be introduced into the line circuit, while viewed in flow direction, further connecting devices connected to the line circuit are brought into a position so that beverage can pass there through such connecting device from a part of the line circuit upstream from the connecting device to a part of the line circuit downstream of the connecting device and the communication between the respective containers and the line circuit is terminated;

(c) whereupon, after that, a connecting device downstream in flow direction is brought into a position so that beverage can be introduced from the respective container into the line circuit, while in a rinsing phase:

(d) each of the connecting devices is brought into a position so that beverage can pass through such connecting device from a part of the line circuit upstream from the connecting device to a part of the line circuit downstream of the connecting device and the communication between the respective containers and the line circuit is terminated;

(e) after which rinsing liquid and/or cleaning liquid is fed through the line circuit, at least such that all connecting devices are flowed through;

(f) while the connecting devices are cooled during at least one of the tapping phase and the rinsing phase.

13. A tapping device according to claim 1, wherein the connecting device is mounted on the container and the cooling line is arranged for cooling the connecting device independent from the container.

14. A tapping device according to claim 1, wherein the connecting device is mounted on the container and the cooling line is arranged for cooling the connecting device during dispensing of beverage from the container.

15. A tapping device according to claim 1, wherein the connecting device comprises a first connection connected to the container and a second connection connected to a beverage dispensing line and a passage between the first and second connections, wherein the cooling line is separate from said passage between the first and second connections.

16. A connecting device according to claim 7, wherein the connecting device comprises a passage between the first and second connections, wherein the cooling line is separate from said passage between the first and second connections.

17. A connecting device according to claim 7, wherein the connecting device is provided with coupling means for mounting the connecting device onto a beverage container.

18. A tapping device according to claim 13, wherein the connecting device is mounted on the container and the cooling line is arranged for cooling the connecting device during dispensing of beverage from the container.

19. A method according to claim 12, wherein the connecting devices are cooled during the tapping phase and also during the rinsing phase.

20. The tapping device of claim 1, wherein the space is an enclosed space.

21. The tapping device of claim 1, wherein the container is holding beer in the beverage-holding portion.

* * * * *